US005372201A

United States Patent [19]

Milberger

[11] Patent Number: 5,372,201

[45] Date of Patent: Dec. 13, 1994

[54] ANNULUS PRESSURE ACTUATED CASING HANGER RUNNING TOOL

[75] Inventor: Lionel J. Milberger, Houston, Tex.

[73] Assignee: ABB Vetco Gray Inc., Houston, Tex.

[21] Appl. No.: 165,991

[22] Filed: Dec. 13, 1993

[51] Int. Cl.[5] ..... E21B 43/01

[52] U.S. Cl. ..... 166/382; 166/348; 166/387

[58] Field of Search ..... 166/348, 382, 368, 208, 166/387

[56] References Cited

U.S. PATENT DOCUMENTS

| | | | |
|---|---|---|---|
| 4,561,499 | 12/1985 | Berner, Jr. et al. | 166/384 |
| 4,595,063 | 6/1986 | Jennings et al. | 166/382 |
| 4,674,576 | 6/1987 | Goris et al. | 166/382 |
| 4,712,621 | 12/1987 | Wightman et al. | 166/382 |
| 4,736,799 | 4/1988 | Ahlstone | 166/348 |
| 4,742,874 | 5/1988 | Gullion | 166/348 |
| 4,969,516 | 11/1990 | Henderson et al. | 166/387 X |
| 5,025,864 | 6/1991 | Nobileau | 166/348 |
| 5,044,442 | 9/1991 | Nobileau | 166/348 X |
| 5,174,376 | 12/1992 | Singeetham | 166/348 X |

*Primary Examiner*—Ramon S. Britts
*Assistant Examiner*—Frank S. Tsay
*Attorney, Agent, or Firm*—James E. Bradley

[57] ABSTRACT

A running tool for setting a casing hanger seal in a subsea well utilizes annulus hydraulic pressure. The running tool has a mandrel which carries a body. A setting sleeve is mounted to the mandrel for movement with the mandrel. An energizing ring secures to the setting sleeve and carries the casing hanger seal. A bulk elastomeric seal is carried by the setting sleeve. The bulk seal seals in the bore of the wellhead housing, enabling hydraulic pressure to be applied for driving the setting sleeve downward to set the casing hanger seal. A safety device prevents the bulk seal from sealing against the bore unless the casing hanger seal has already moved to its desired position in the pocket between the casing hanger and the bore of the wellhead housing.

18 Claims, 9 Drawing Sheets

ANNULUS PRESSURE ACTUATED CASING HANGER RUNNING TOOL

BACKGROUND OF THE INVENTION

1. Field of the Invention

This invention relates in general to subsea oil and gas wells, and in particular to a running tool for installing casing and setting a casing hanger seal remotely in a subsea wellhead housing.

2. Description of the Prior Art

In a subsea well of the type concerned herein, a wellhead housing locates on the sea floor. Strings of casing extend into the well, with the casings being supported in the wellhead housing. A casing hanger seal is installed between the casing hanger at the upper end of the casing and the wall of the wellhead housing. The operator installs the casing and the seal remotely and sometimes in seas of considerable depths.

There have been a number of types of running tools used and proposed in the patented art. With the advent of metal-to-metal casing hanger seals, the forces required to set these seals are greater than the prior art elastomeric seals. Running tools have to be capable of delivering very large forces. One type utilizes hydraulic pressure, as shown in U.S. Pat. Nos. 4,969,516 and 4,928,769. The hydraulic pressure is generated by axial movement of the drill string, which moves a piston within a sealed hydraulic chamber in the running tool. These hydraulic tools work well. However, they are complex and expensive.

U.S. Pat. No. 5,044,442 shows a type that is hydraulically actuated, but uses annulus pressure. Rams are closed around the drill string, creating a chamber located above the wellhead housing within the riser. A bulk seal seals a portion of the running tool to the wellhead housing above the setting sleeve and casing hanger seal. The bulk seal enables pressure to be applied to a piston of the running tool. Fluid is pumped down a choke and kill line to this chamber, which actuates the piston within the running tool to set the casing hanger seal.

The annulus pressure actuated hydraulic tool described in that patent is feasible, however a possibility exists that the bulk seal could seal on the wellhead housing at a point above the desired position. If so, the casing hanger seal might be actuated before it is located fully within the pocket between the casing hanger and the bore of the wellhead housing.

SUMMARY OF THE INVENTION

In this invention, the running tool is of an annulus pressure actuated type. It utilizes a mandrel which connects to a string of conduit. A body is carried by the mandrel, the body releasably connecting to the casing hanger. An energizing member carries the casing hanger seal. The energizing member is movable relative to the body between an upper position wherein the casing hanger seal is spaced above the pocket, and a lower position wherein the casing hanger seal locates in the pocket.

A bulk seal is mounted above the casing hanger seal. A setting sleeve mounts to the mandrel and is engagable with the bulk seal and energizing member. The setting sleeve can move downward relative to the body to position the casing hanger seal within the pocket. Also, the setting sleeve can move a limited distance downward relative to the energizing member to deform the bulk seal against the wellhead housing when the casing hanger seal is in the pocket. This enables hydraulic pressure to be applied through the choke and kill line to the annulus surrounding the mandrel. The hydraulic pressure causes the setting sleeve and energizing member to then move downward relative to the casing hanger seal to set the casing hanger seal.

The running tool has an indicating means for indicating when the casing hanger seal has properly landed in the pocket. This indicating means comprises a stop shoulder located on the body of the running tool. A safety means cooperates with the indicating means for preventing the setting sleeve from moving downward relative to the energizing member unless the casing hanger seal is properly located in the pocket. The safety means comprises a safety ring which is split. When it contacts the stop shoulder, it will move radially outward, allowing the setting sleeve to move downward relative to the energizing member to set the bulk seal.

DETAILED DESCRIPTION OF THE INVENTION

Figure 1A:
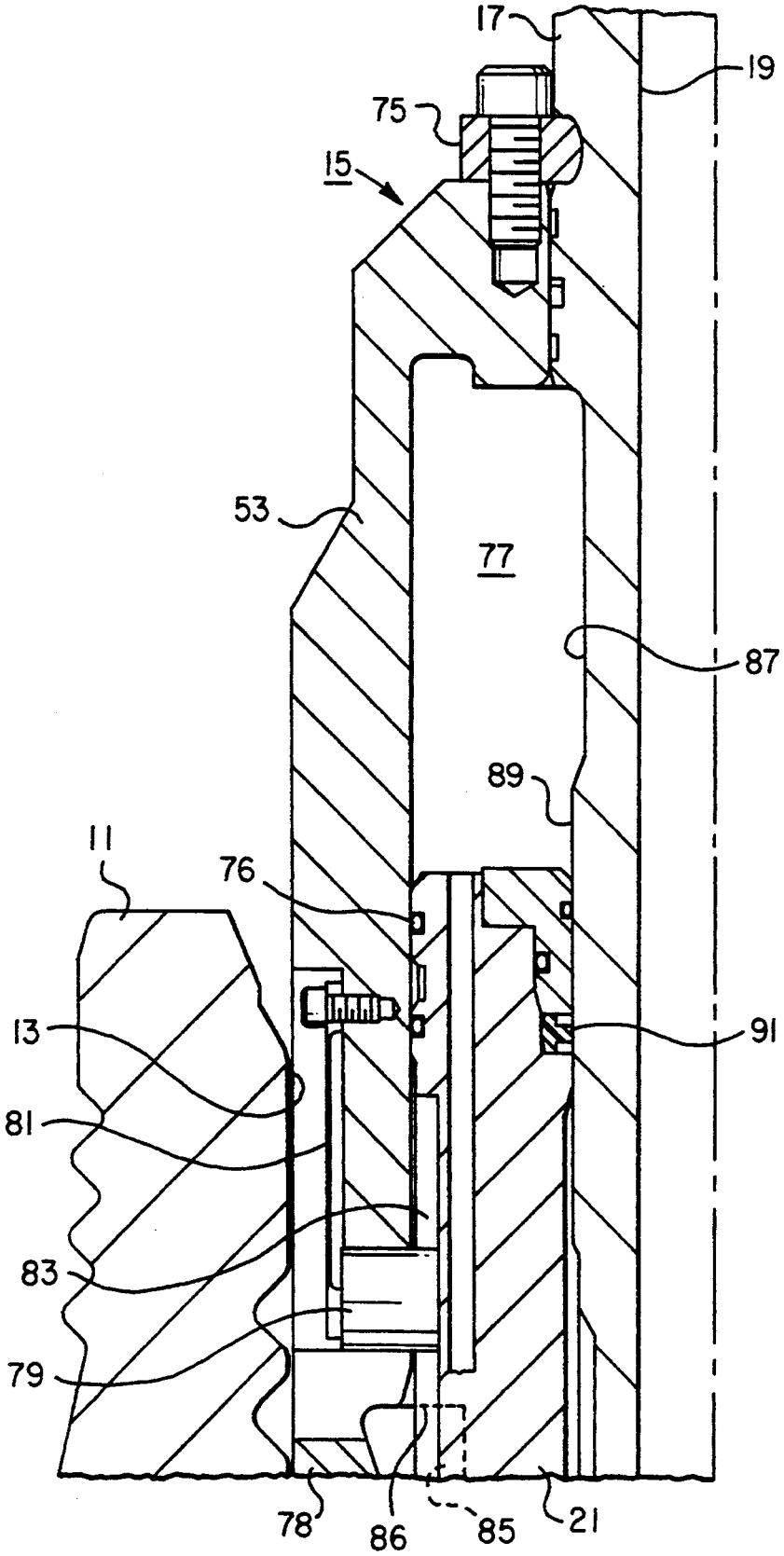
FIGS. 1A and B comprise a quarter sectional simplified view of a running tool constructed in accordance with this invention and shown connected to a casing hanger in a cementing position.
Figure 1B:
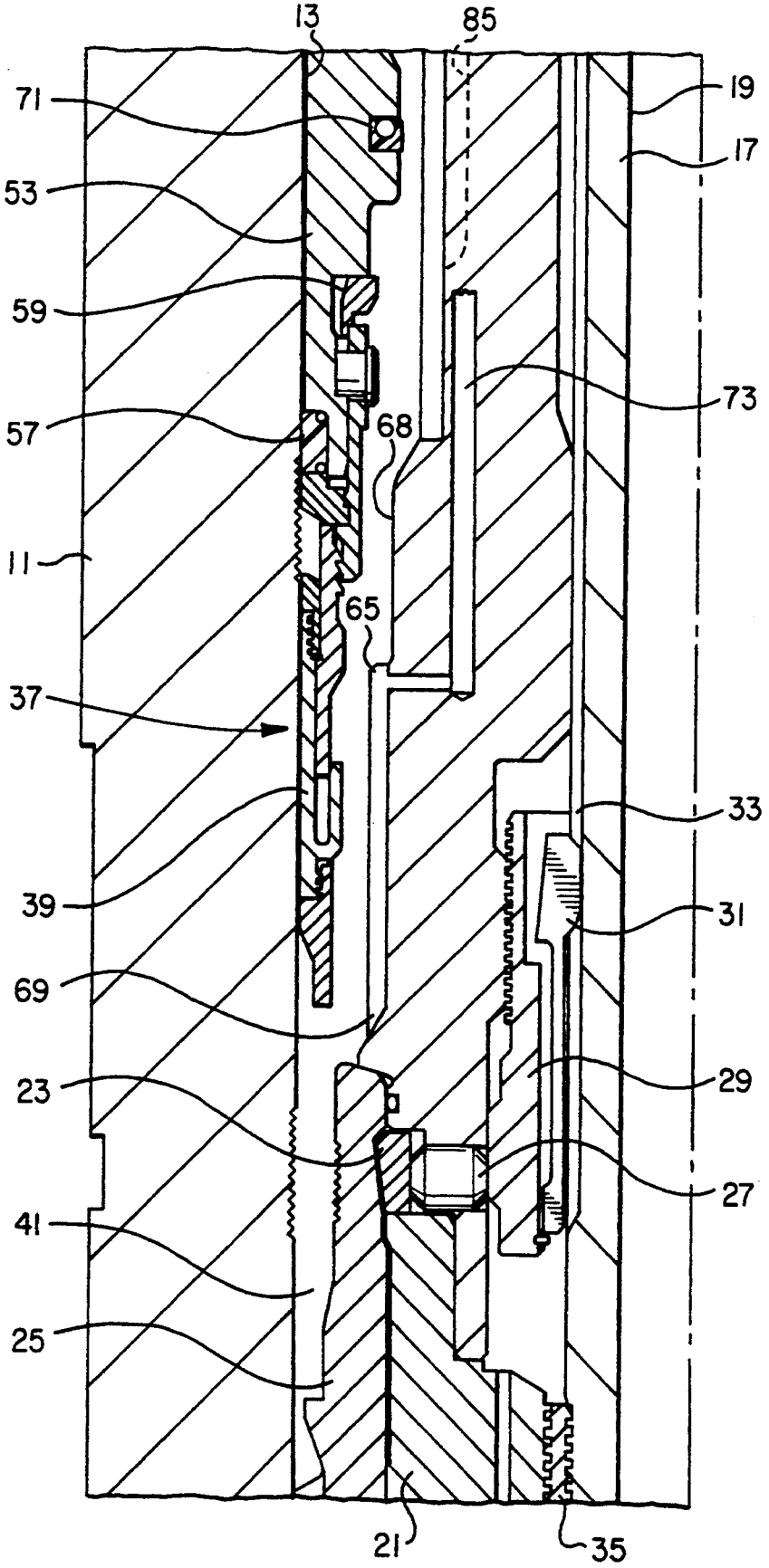

Referring to the FIGS. 1A and 1B, the subsea well has a wellhead housing 11, which is a large tubular member located at the sea floor. Wellhead housing 11 has a bore 13. A riser (not shown) connects the exterior of wellhead housing 11 to a drilling vessel at the surface. Wellhead housing 11 will have been previously installed with its lower end secured to a string of conductor pipe (not shown) that extends into the well at a first depth. The well is then drilled to a greater depth and a first string of casing (not shown) is installed in wellhead housing 11. Subsequently, the well is drilled to an even greater depth, with often at least one more string of casing installed and sealed within bore 13 of wellhead housing 11.

Running tool 15 is shown installing one of the strings of casing. Running tool 15 has a tubular mandrel 17 which is threaded on its upper end for connecting to a string of drill pipe (not shown). An axial passage 19 extends through mandrel 17 for fluid passage, such as cement. Mandrel 17 carries a body 21 for axial movement relative thereto. Body 21 has an engaging ring 23 (Fig. 1B) for engaging a groove in a casing hanger 25.

Casing hanger 25 secures to the upper end of a string of casing (not shown).

Engaging ring 23 is a split ring and is moved radially outward to the locked position shown by a plurality of link members 27. Link members 27 extend radially through holes in a portion of body 21. A threaded actuator 29 will move the link members 27 radially inward and outward depending upon the axial position of actuator 29 relative to body 21.

Threaded actuator 29 is threaded to body 21. A spring biased key 31 causes rotation of mandrel 19 to rotate threaded actuator 29 relative to body 21. Key 31 engages a vertical spline 33 located on mandrel 17. When mandrel 17 is rotated in a selected direction, threaded actuator 29 will move downward to allow link members 27 and engaging ring 23 to retract to release running tool 15 from casing hanger 25. This portion of running tool 15 is similar to that shown in U.S. Pat. Nos. 4,969,516 and 4,928,769, all of which material is hereby incorporated by reference.

Mandrel 17 has an upper position, which is shown in FIGS. 1A and 1B, and various lower positions relative to body 21, these positions being shown in the other figures. A threaded sleeve 35 retains mandrel 17 in the upper position while it is running the casing hanger 25 and casing into the well.

Running tool 15 has an energizing member or assembly 37 which carries a casing hanger seal 39. Casing hanger seal 39 is adapted to locate in a pocket 41 between the upper exterior of casing hanger 25 and the wall of bore 13. FIG. 1B shows casing hanger seal 39 in an upper position above pocket 41 for cementing operations, while FIGS. 2B, 3, 4 and 5A and 5B show casing hanger seal 39 located in pocket 41.

Figure 3:
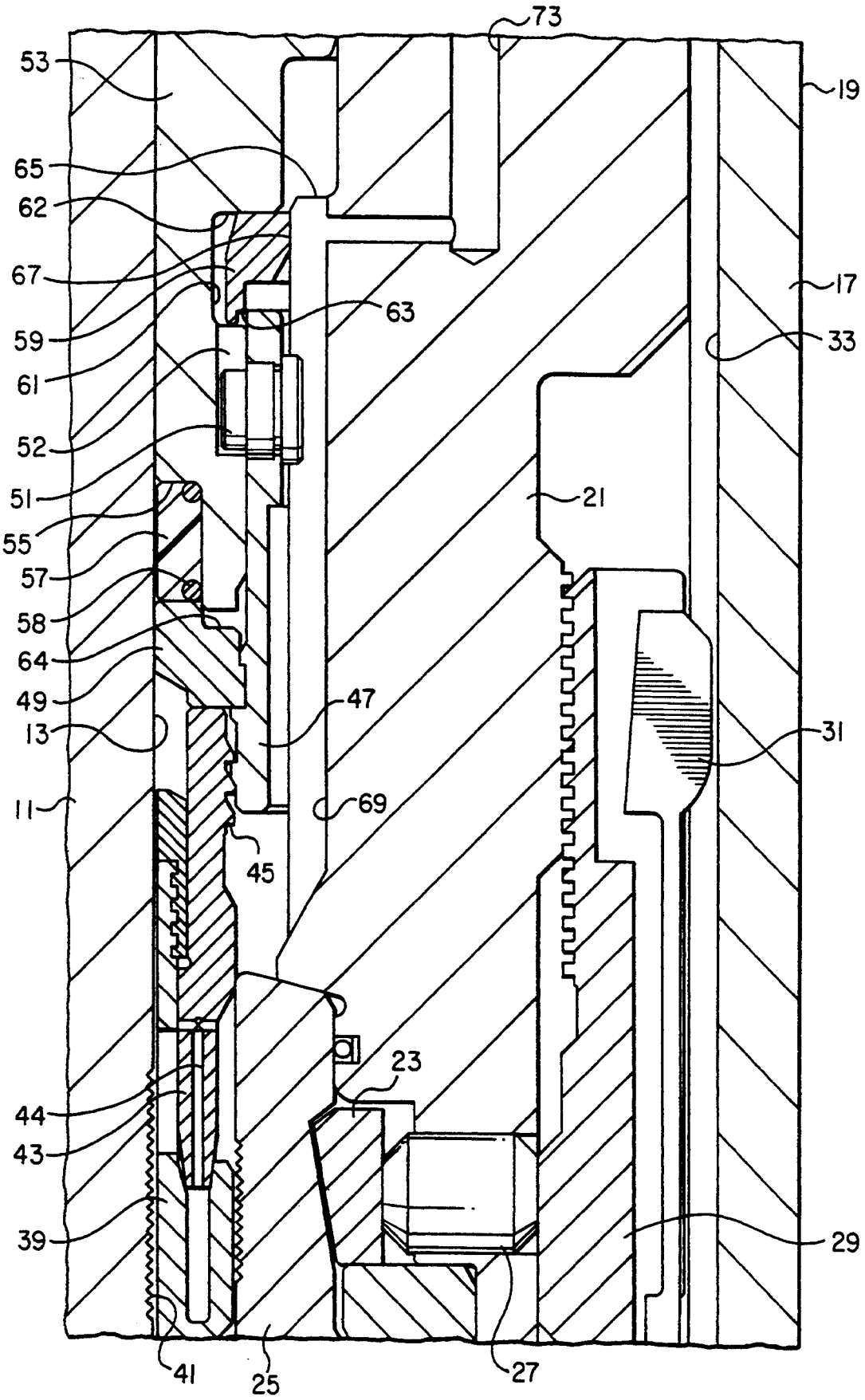
FIG. 3 is an enlarged and more detailed sectional view of a portion of the running tool of FIG. 1, shown in the position of FIGS. 2A and 2B.
Figure 4:
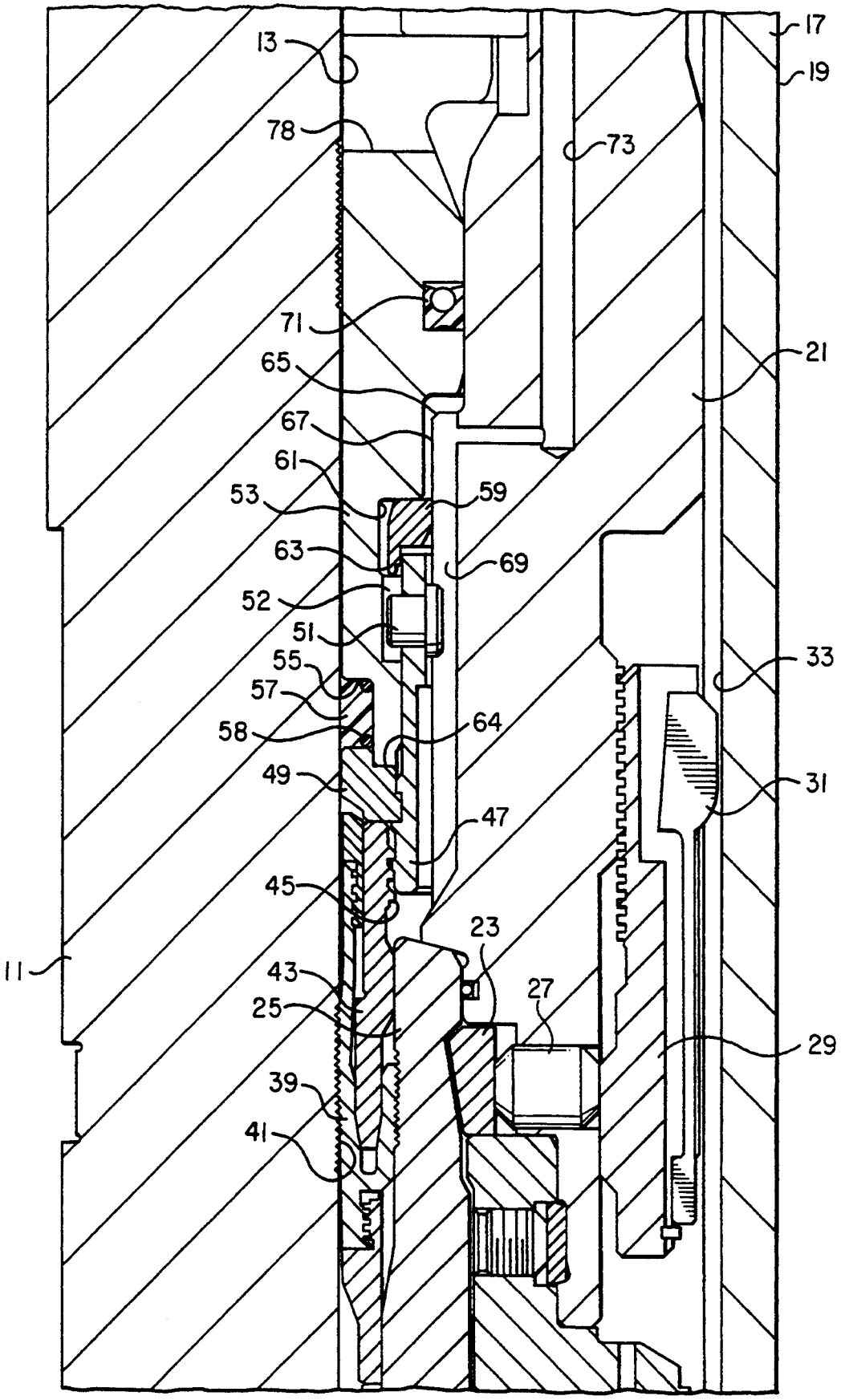
FIG. 4 is an enlarged and more detailed sectional view of a portion of the running tool of FIG. 1, showing the casing hanger seal in the set position.

Casing hanger seal 39 and energizing assembly 37 are conventional. As shown in FIGS. 3 and 4, energizing assembly 37 includes an energizing ring 43 that inserts between inner and outer walls of casing hanger seal 39 to spread the walls apart to cause the setting. Relief ports 44 (shown only in FIG. 3) extend through energizing ring 43 to allow the displacement of fluid trapped between the walls of casing hanger seal 39. Energizing ring 43 has on its upper interior portion a set of grooves 45 which releasably secure to a carrier ring 47. A compression ring 49 locates on top of energizing ring 43. When hydraulic pressure is applied to running tool 15 while it is in the setting mode, compression ring 49 exerts a downward force on energizing ring 43 to move it from the position shown in FIG. 3 to that shown in FIG. 4.

Carrier ring 47 is secured by pins 51 extending into slots 52 in a setting sleeve 53. Slots 52 have a greater axial length than the diameter of pins 51, enabling some axial movement of carrier ring 47 relative to setting sleeve 53, as can be seen by comparing FIGS. 3 and 4.

Setting sleeve 53 has a downward facing compression shoulder 55 spaced axially above an upper surface of compression ring 49, which also comprises a compression shoulder. An elastomeric bulk seal 57 is carried in the recess between the compression shoulder 55 and compression ring 49. Bulk seal 57 is a large elastomeric seal, preferably rectangular in cross section. Solid metal rings 58 are molded within bulk seal 57, near the inner diameter at the upper and lower surfaces. Metal rings 58 prevent bulk seal 57 from being pulled from its seat as running tool 15 passes through a blowout preventer (not shown) in the riser between wellhead housing 11 and the drilling vessel. Bulk seal 57 is energized by axial movement of the compression shoulder 55 toward compression ring 49. Bulk seal 57 is shown in an unenergized position in FIG. 3, and in an energized position in FIG. 4, sealing against bore 13.

A safety means prevents bulk seal 57 from moving to the energized position until casing hanger seal 39 is fully located in pocket 41. The safety means includes a safety ring 59. Safety ring 59 is a metal split ring carried in a recess 61 in setting sleeve 53. Recess 61 is located at the upper ends of the slots 52. Setting sleeve 53 has a downward facing shoulder 62 that contacts the upper side of safety ring 59 and is of smaller inner diameter than a portion of setting sleeve 53 at slots 52. Safety ring 59 has a lower notch shoulder 63 that will locate on top of carrier ring 47 when safety ring 59 is in the retracted locked position. The top of carrier ring 47 is an upward facing shoulder. In this position, shown in FIG. 1B, downward load on setting sleeve 53 transmits from shoulder 62 through safety ring 59 to carrier ring 47. This prevents any downward movement of setting sleeve compression shoulder 55 relative to compression ring 49.

When safety ring 59 is pushed outward to the released position, shown in FIGS. 3 and 4, notch shoulder 63 moves off of carrier ring 47 and safety ring 59 moves outward radially within recess 61. When notch shoulder 63 moves off of the upper end of carrier ring 47, a limited amount of downward travel of setting sleeve 53 can occur relative to carrier ring 47. The downward travel is limited by the contact of a limit shoulder 64 on the upper side of compression ring 49 with the lower end of setting sleeve 53. FIG. 3 shows limit shoulder 64 separated by a gap from the lower end of setting sleeve 53, while FIG. 4 shows limit shoulder 64 in contact with setting sleeve 53. Limit shoulder 64 limits the amount of deformation to bulk seal 57 when it is moved to the energized position. The downward movement of setting sleeve 53 relative to carrier ring 47 occurs because notch shoulder 63 no longer engages carrier ring 47 to prevent the downward movement, and because casing hanger seal 39 will have engaged a stop surface on the exterior of casing hanger 25.

Safety ring 59 is moved to the outer released position by contact with body stop shoulder 65 on body 21. Body stop shoulder 65 faces upward and is positioned so that it will be contacted by safety ring 59 only when casing hanger seal 39 is properly located in pocket 41. After contacting body stop shoulder 65, safety ring 59 will slide downward on the exterior portion 67 of body 21 directly below stop shoulder 65. Safety ring 59 has a bevelled lower inner diameter to facilitate the radial outward movement that occurs when contacting body stop shoulder 65. Body stop shoulder 65 thus serves as an indicator means to indicate to safety ring 59 when casing hanger seal 39 is located in pocket 41.

Body exterior portion 67 has axial grooves 69 extending downward from stop shoulder 65 on its exterior for the passage of fluids during the running and setting action. The heads of pins 51 extend into the grooves 69. Body 21 has an exterior cylindrical seal surface 68 located above exterior portion 67 and of smaller diameter. An elastomeric seal 71 locates between an inner portion of setting sleeve 53 and seals on exterior portion 68 above grooves 69 when mandrel 17 is in a lower position. A passage 73 extends from grooves 69 to the upper end of body 21, as shown in FIG. 1A. Passage 73 is not shown in FIG. 6 because of the different section plane.

Referring again to FIG. 1A, setting sleeve 53 extends upward past body 21 and is carried by mandrel 17. A bearing ring 75 mounts setting sleeve 53 to mandrel 17, and allows rotation of mandrel 17 relative to setting sleeve 53. An annular chamber 77 locates between an interior portion of setting sleeve 53 and mandrel 17. The upper end of body 21 serves as the lower end of chamber 77, with seals 76 engaging an inner cylindrical wall of setting sleeve 53. A plurality of cement return ports 78 extend through the wall of setting sleeve 53.

A plurality of circumferentially spaced apart dogs 79 are mounted to setting sleeve 53 by flat springs 81. Dogs 79 extend through holes in setting sleeve 53 above cement return ports 78. Some of the dogs 79 engage long slots 83 on the exterior of body 21. These long slot dogs 79 always remain in engagement with the long slots 83.

Figure 2A:
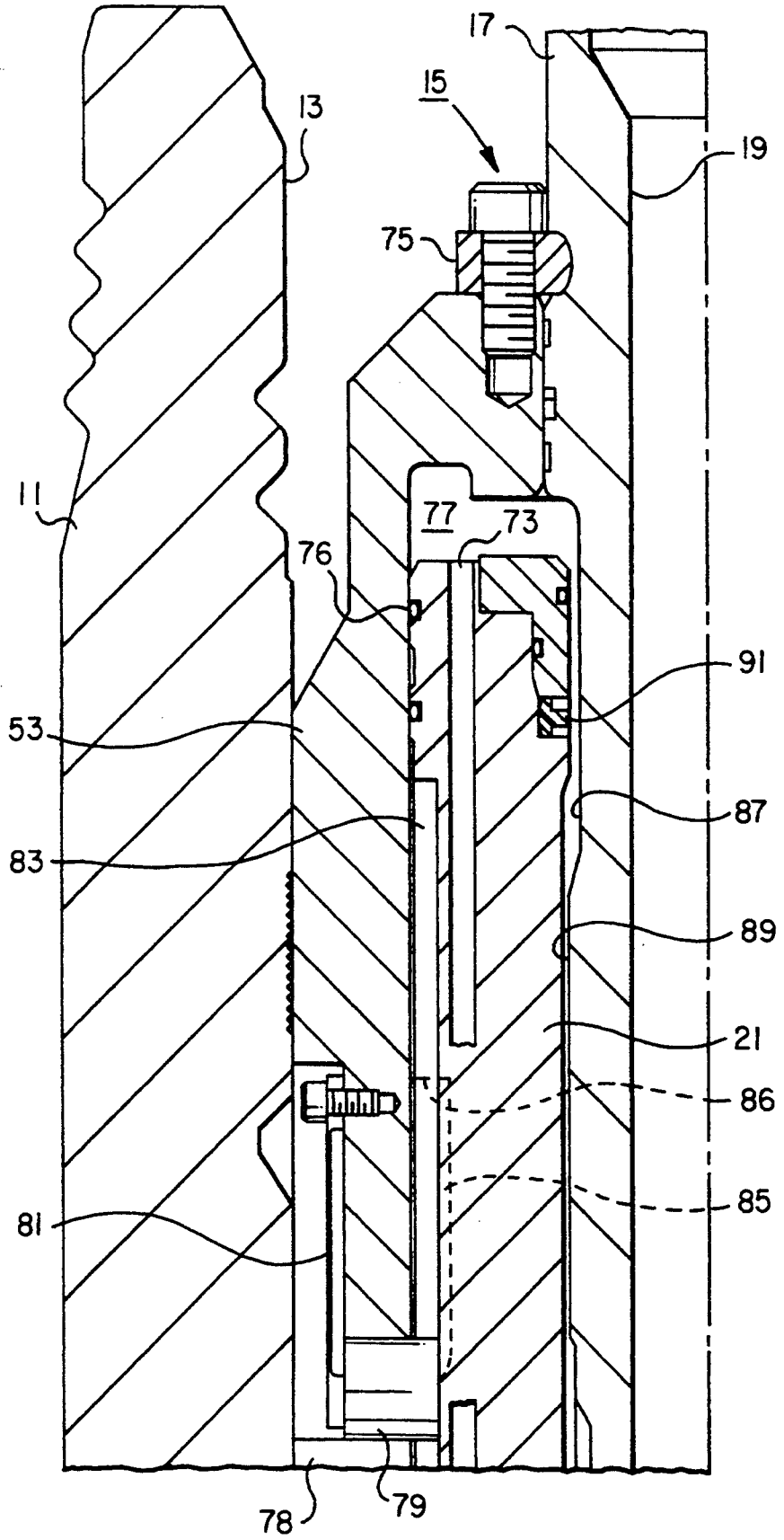
FIGS. 2A and 2B comprise a quarter sectional simplified view of the running tool of FIG. 1, showing the running tool with the casing hanger seal properly located in the pocket, but prior to being set.
Figure 2B:
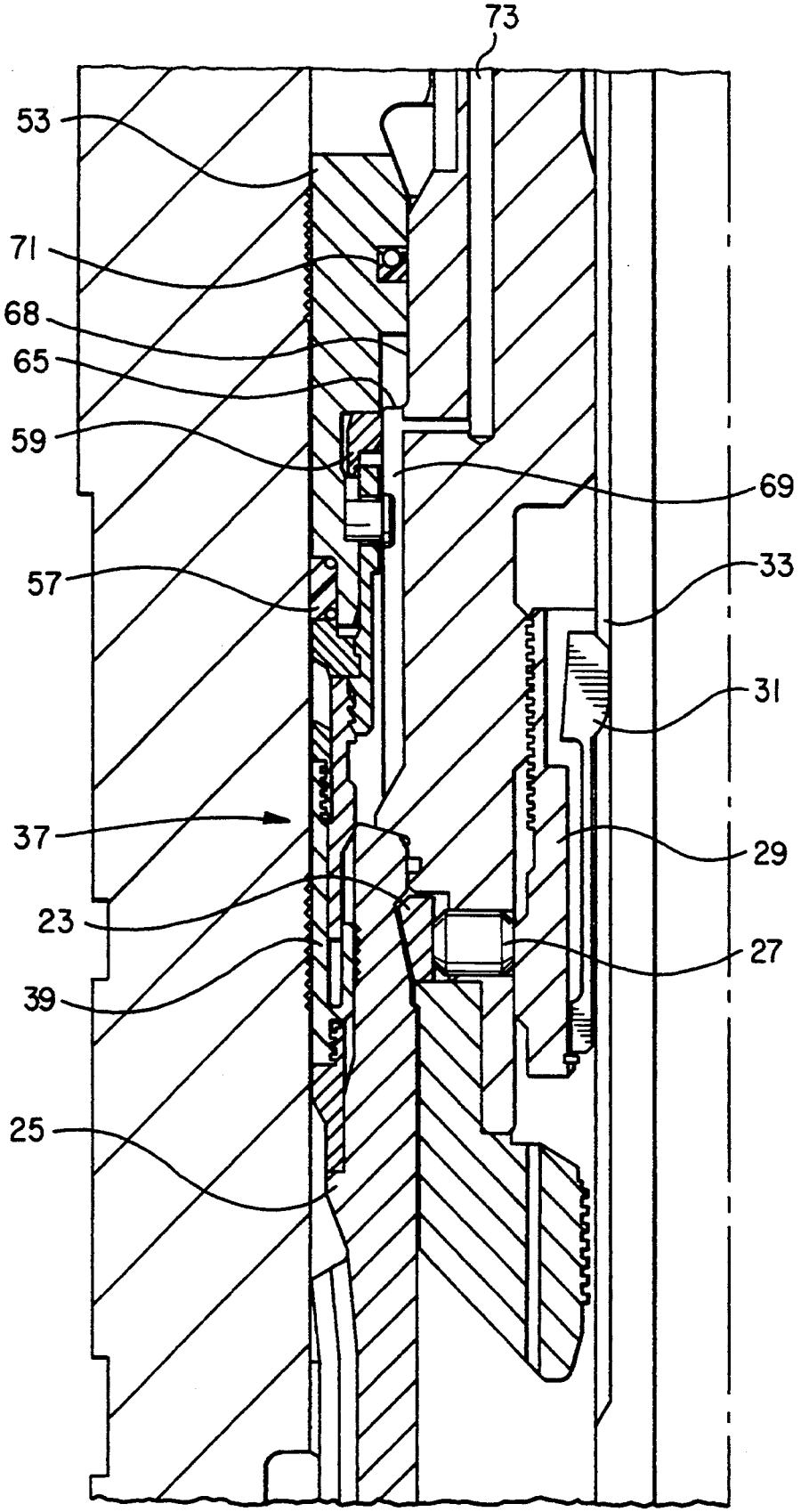

Long slots 83 are alternated with short slots 85, which are in a different section plane than the figures and are shown only by dotted lines. The short slots 85 are shorter than the long slots 83, with upper ends 86 that are below the upper ends of the long slots 83 and which comprise downward facing shoulders. Some of the dogs 79 engage the short slots 85 and are not shown in the figures. When the mandrel 17 moves downward as shown in FIGS. 2A and 2B, the short slot dogs 79 will enter the short slots 85. When mandrel 17 is subsequently picked up, the short slot dogs 79 will engage the upper ends 86 to hold mandrel 17 and setting sleeve 53 in the position shown in FIG. 5 for testing after the setting of casing hanger seal 39.

Figure 6:
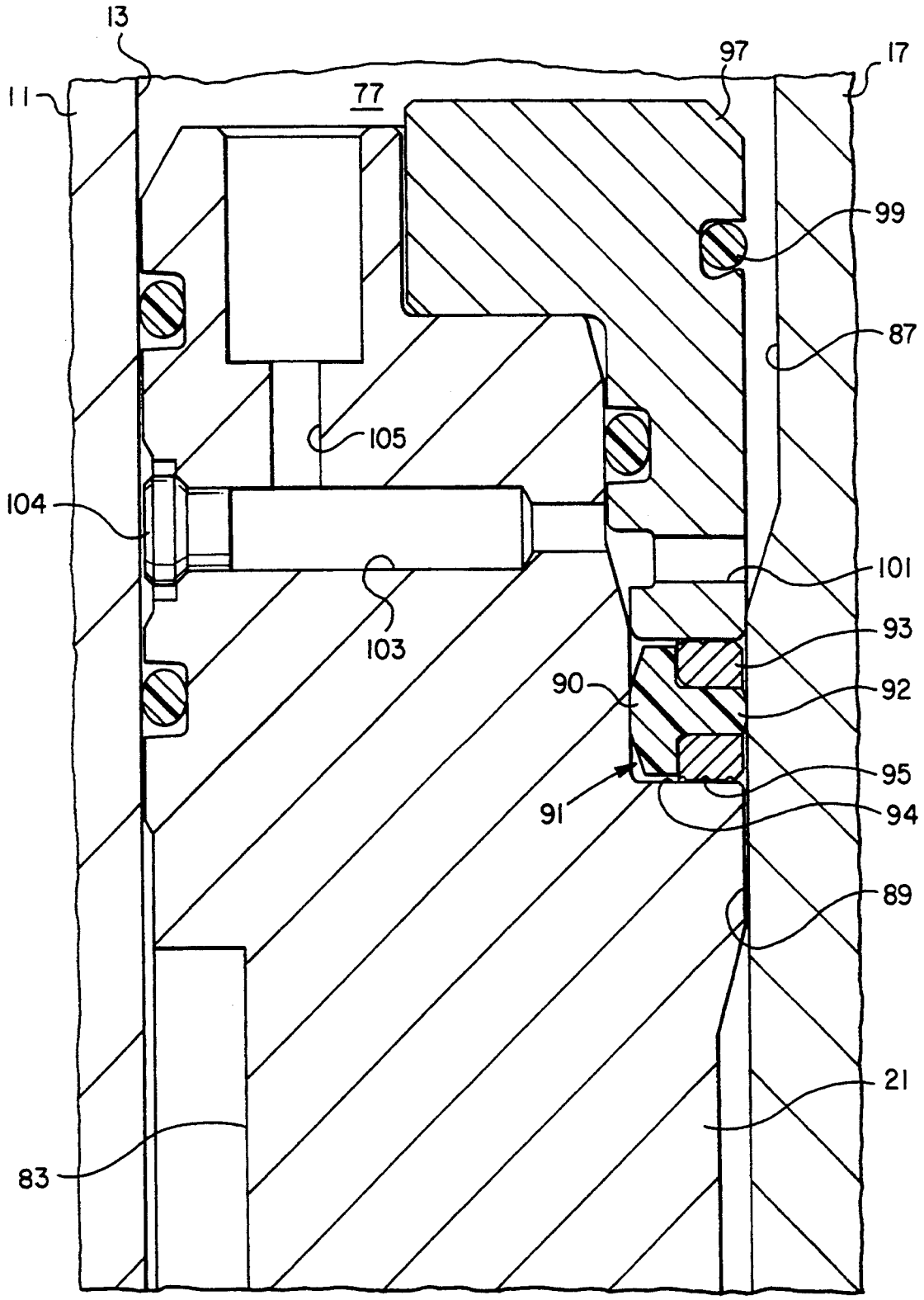
FIG. 6 is an enlarged and more detailed view of an upper portion of the body of the running tool of FIG. 1, illustrating a T-seal.

Chamber 77 is defined on its inner diameter by a recessed wall 87 and a seal wall 89, both exterior cylindrical portions of mandrel 17. Recessed wall 87 has a lesser outer diameter than seal wall 89. As shown in FIG. 6, a T-seal 91 is mounted in a seal seat 94 on the inner diameter of body 21. T-seal 91 has a flange 90 which extends axially. A leg 92 extends radially inward from flange 90. Leg 92 seals against seal wall 89, but will be spaced from recessed wall 87 when mandrel 17 is in a lower position relative to body 21. T-seal 91 is a fairly hard plastic member, preferably constructed of Hytrel, and having a durometer shore of 55 D.

A pair of metal rings 93 have outer diameters that abut the inner diameter of flange 90. One of the metal rings 93 locates on the upper surface of leg 92, while the other locates of the lower surface of leg 92. Both metal rings 93 are generally rectangular in cross section and do not extend quite as far radially from flange 90 as leg 92. The inner diameters of metal rings 93 are less than the inner diameter of leg 92 to prevent the metal rings 93 from touching the seal wall 89. Metal rings 93 are rigid and solid. Bleed grooves 95 locate on the upper surface of the upper metal ring 93 and the lower surface of the lower metal ring 93 to prevent metal rings 93 from sealing against the upper and lower walls of seal seat 94, and to allow bleed through of any trapped fluid. Metal rings 93 prevent a pressure difference from pulling T-seal 91 out of its seal seat 94 when transitioning from the seal wall 89 to the recessed area 87. In one mode of movement to be explained later, there will be a lower pressure in the chamber 77 than a pressure below T-seal 91 while T-seal 91 engages seal surface 89 as mandrel 17 moves downward relative to body 21. The lower pressure in chamber 77 would tend to pull T-seal 91 out of its seal seat 94 as it passes the transition between seal surface 89 and recessed area 87, but the metal rings 93 prevent this occurrence.

Referring still to FIG. 6, a retainer 97 holds T-seal 91 in its position. Retainer 97 is secured by vertically extending bolts (not shown) which engage the upper end of body 21. Removing retainer 97 allows T-seal 91 to be placed in seal seat 94 and serves as the upper shoulder of seal seat 94. Retainer 97 is an annular ring and has a test O-ring 99 on its inner diameter. O-ring 99 does not perform any function during operation of running tool 21, but can be used to test whether T-seal 91 is effectively sealing against seal wall 89.

A retainer test passage 101 extends through retainer 97 from the outer diameter of retainer 97 to the inner diameter of retainer 97 below O-ring 99. A body test passage 103 extends radially through body 21, and registers with retainer test passage 101. A communication passage 105 extends upward from body test passage 103, and leads to chamber 77. A removable plug 104 normally closes body test passage 103 to the exterior of body 21. Passages 101, 103 and 105 are not shown in the other figures because of a different section plane.

Briefly explaining passages 101, 103 and 105 of FIG. 6, during normal operation, retainer test passage 101 will always be open to chamber 77 through passages 103 and 105. Consequently, there will be no pressure differential on O-ring 99 as it will have the same pressure from chamber 77 both above and below it at all times. This prevents pressure differential from pulling O-ring 99 out of its seat as it passes from sealing against seal wall 89 to being spaced from recessed wall 87.

During maintenance while running tool 15 is at the surface, setting sleeve 53 will be removed. A source of hydraulic pressure will be connected to the upper end of passage 105. Mandrel 17 will be positioned so that both O-ring 99 and T-seal 91 are sealing against seal wall 89. Then hydraulic pressure is applied to passage 103, which applies pressure between O-ring 99 and T-seal 91 via test passage 101. This test determines whether T-seal 91 is effectively sealing against seal wall 89. The hydraulic source is removed and setting sleeve 53 is then placed back on the running tool 15.

In the overall operation, the casing will be run into the well and casing hanger 25 initially supported at the rig floor. Running tool 15 will insert into casing hanger 25. Mandrel 17 will be rotated to cause pins 27 to push engaging ring 23 out to lock running tool 15 to casing hanger 25, as shown in FIG. 1B. The upper end of mandrel 17 is connected to drill pipe. Mandrel 17 is in the upper position shown in FIGS. 1A and 1B, with casing hanger seal 39 spaced above casing hanger 25. Dogs 79 are out of engagement with the short slots 85 and some are in engagement with the long slots 83. The operator lowers the drill pipe, running tool 15, casing hanger 25 and casing.

Casing hanger 25 will land on a load shoulder (not shown) in bore 13 of wellhead housing 11. This is the position shown in FIG. 1B. Casing hanger seal 39 will be spaced above pocket 41. Mandrel 17 will still be in an upper position relative to body 21. The operator then pumps cement down the drill string. The cement flows through mandrel passage 19 and out the bottom of the casing. The cement flows back up an annulus surrounding the casing. Cement returns flow up flowby slots on the exterior of casing hanger 25, and up along body exterior portions 67 and 68. Seal 71 will be spaced above body exterior portion 68, allowing flow up and out cement return ports 78. The cement returns flow up the recesses on the outer diameter of sleeve 15 which also contain the springs 81 of dogs 79. Passage 73 is open at its lower end, but cement returns fluid will not flow into chamber 77 because T-seal 91 will be sealing against mandrel seal surface 89.

After cementing has been completed, the operator then rotates mandrel 19 to cause sleeve 35 to unscrew mandrel 19 from body 21 (Fig. 1B). Mandrel 19 then drops downward due to the weight of the drill pipe, bringing along with it setting sleeve 53. Setting sleeve 53 and casing hanger seal 39 will move to the position shown in FIGS. 2A and 2B and FIG. 3, with casing hanger seal 39 moving into its proper location in pocket 41. Some of the dogs 79 will now engage the short slots 85, while others remain in engagement with the long slots 83.

Seal 71 will seal against body exterior portion 68, blocking hydrostatic pressure in the annulus around the drill pipe from passage 73 and chamber 77. The pressure in chamber 77 thus becomes low, isolated from the hydrostatic pressure by seal 71. Shortly after seal 71 moves into engagement with body exterior portion 68, T-seal 91 will move out of sealing engagement with mandrel seal surface 89, and enter the recessed area 87. The pressure below T-seal 91 immediately before moving out of engagement with seal surface 89 was at hydrostatic pressure due to mandrel splines 33 being in communication with the interior of the drill pipe and casing below running tool 15. The metal rings 93 (FIG. 6) prevent the difference in pressure across T-seal 91 from pulling it from its seat 94 as it leaves seal surface 89. Once T-seal 91 is in recessed area 89, the pressure in chamber 77 will increase to hydrostatic because of communication through splines 33 on mandrel 17 with the hydrostatic pressure below running tool 15 within the casing and the drill pipe.

During the downward movement of mandrel 17 relative to body 21, fluid trapped in the space between casing hanger 25 and casing hanger seal 39 will be displaced upward through grooves 69 and passage 73. The trapped fluid flows up passage 73 into chamber 77. As chamber 77 decreases in volume during the downward movement, the fluid in chamber 77 flows down recessed area 87 and splines 33 on mandrel 17 to the casing below running tool 15.

During the initial part of the downward movement, safety ring 59 will be in its contracted position, located with notch shoulder 63 bearing against carrier ring 47, preventing any downward movement of setting sleeve 53 relative to energizing ring 43 (FIGS. 3 and 4). The weight on setting sleeve 53 thus transmits through safety ring 59 to carrier ring 47, preventing any downward movement of compression shoulder 55 relative to compression ring 49 while safety ring 59 is in the position shown in FIG. 1B.

Then, as casing hanger seal 39 lands in pocket 41, as shown in FIGS. 2B, 3 and 4, body stop shoulder 65 will contact safety ring 59, pushing it radially outward to the released position. In the released position, notch shoulder 63 will disengage from the upper end of carrier ring 47. Carrier ring 47 will not be able to move farther downward because casing hanger seal 39 will now be located on a shoulder in pocket 41. Setting sleeve 53, however, can continue downward movement until contacting limit shoulder 64. This limited downward movement moves compression shoulder 55 downward relative to compression ring 49, deforming bulk seal 57 to the position shown in FIG. 4. Up to this point, the positioning of casing hanger seal 39 has been due to the weight of the drill string applied on mandrel 17 and setting sleeve 53. As shown in FIG. 3, the energizing ring 43 has not set the casing hanger seal 39.

The wellhead housing 11 is connected to the drilling vessel through a riser (not shown), creating an annular space between the riser and mandrel 17. Rams (not shown) are closed on the drill pipe above mandrel 17. Choke and kill lines (not shown) lead to this annular space around mandrel 17 above setting sleeve 53. The operator applies hydraulic pressure to the choke and kill lines. The hydraulic fluid acts on the setting sleeve 53 as a result of the bulk seal 57. The pistons created by the bulk seal 57 and seal 76 cause the setting sleeve 53 to move downward. Bulk seal 57 also slides downward. Energizing ring 43 moves downward to the position shown in FIG. 4. Note that during this downward movement under hydraulic pressure, the T-seal 91 will not be sealing against the chamber seal wall 89. Rather it will be positioned in the recessed area 87. Displaced fluid from chamber 77 thus may flow down splines 33 of mandrel 17 to the casing below running tool 15. Trapped fluid between the walls of casing hanger seal 39 flows up relief ports 44, grooves 69 and passage 73 to chamber 77. During this final downward movement, safety ring 59 will slide down body exterior portion 67.

Figure 5A:
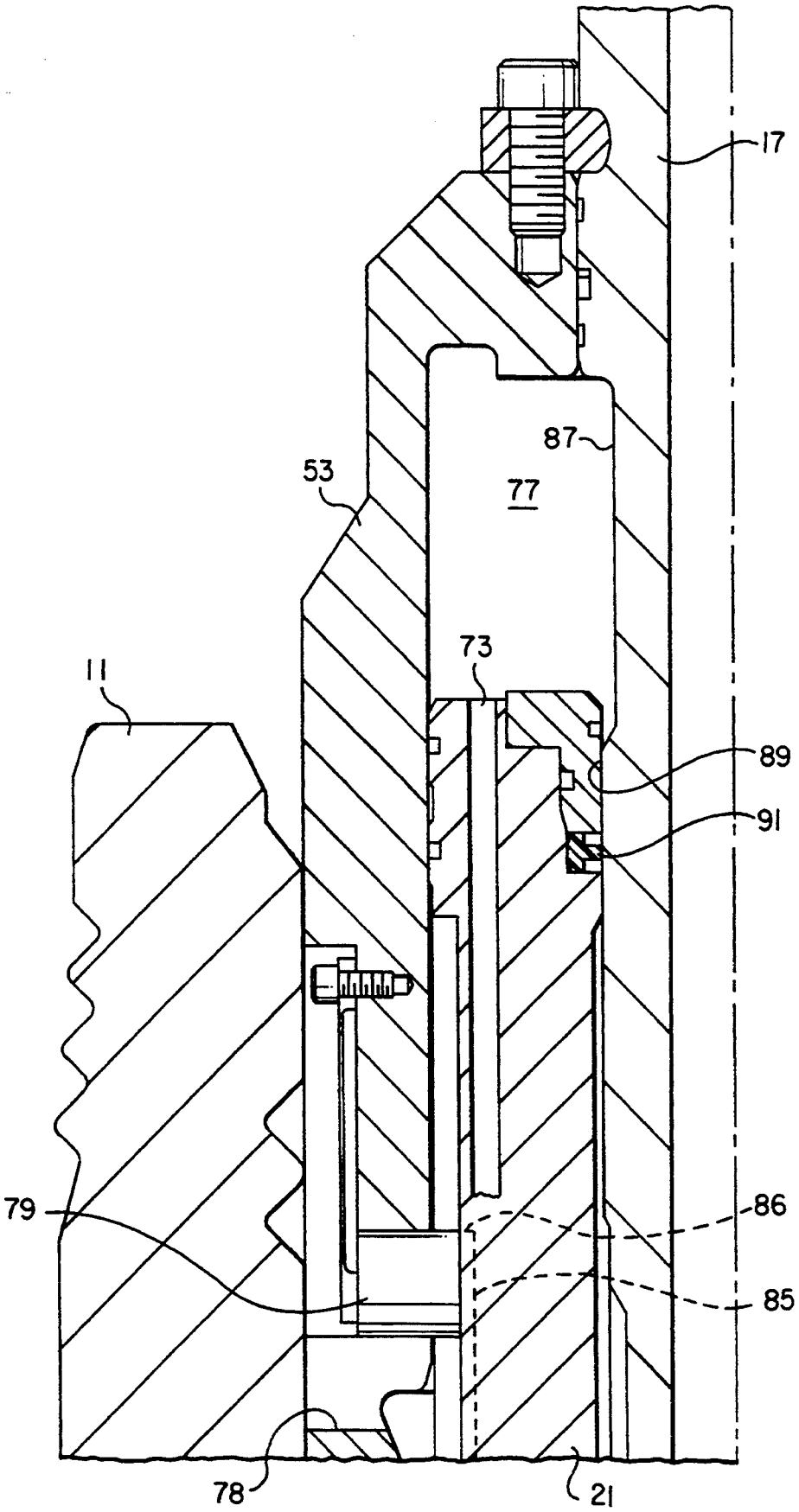
FIGS. 5A and 5B comprise a quarter sectional view of the running tool of FIG. 1, with the running tool picked up for testing the casing hanger seal after setting.
Figure 5B:
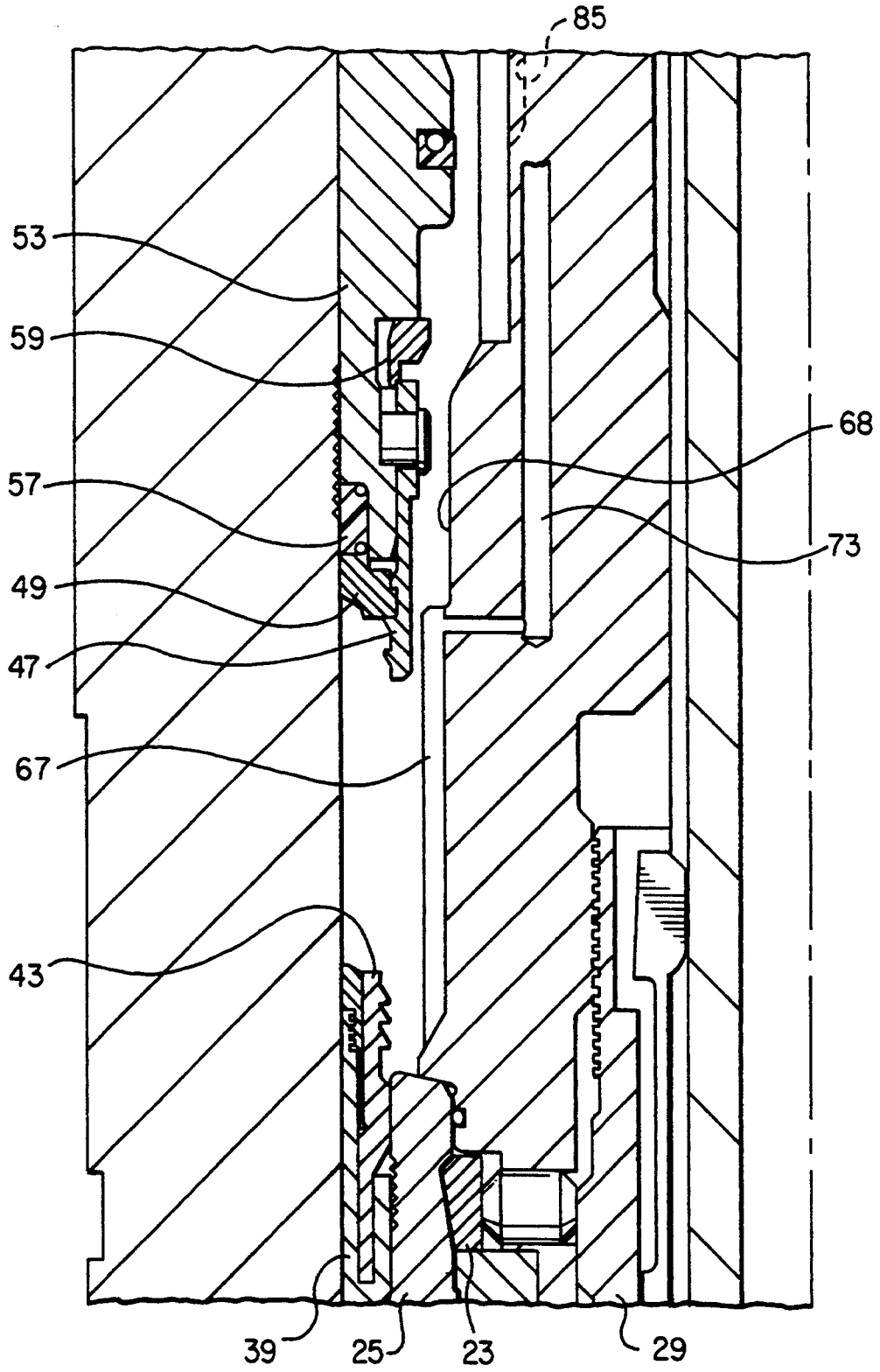

When casing hanger seal 39 has been fully set, the operator relieves the hydraulic pressure and picks up the drill pipe, bringing along with it mandrel 17, but not body 21, which is still attached to casing hanger 25. Carrier ring 47 will pull loose from energizing ring 43, as illustrated in FIGS. 5A and 5B. The short slot dogs 79 will slide upward in the short slots 85, and engage the shoulders at the upper ends 86. This stops the mandrel 17 from further upward movement relative to body 21. At this point, the T-seal 91 will move back in sealing engagement with chamber seal wall 89.

Hydraulic pressure may now be pumped again through the choke and kill line. The pressure now flows through external slots on setting sleeve 53, through ports 78 and acts against the casing hanger seal 39 for testing. Any fluid that flows up passage 73 cannot escape because of the engagement of T-seal 91 with chamber seal wall 89.

If the test proves satisfactory, the operator relieves the hydraulic pressure and rotates mandrel 17 to shift threaded actuator 29 (Fig. 1B) axially to release engaging ring 23 from engagement with casing hanger 25. Running tool 15 may then be retrieved to the surface.

The invention has significant advantages. The safety ring and stop shoulder prevent the bulk seal from sealing until the casing hanger seal is properly located in the pocket. This prevents inadvertent setting of the casing hanger seal above the desired location. The metal rings that support the T-seal allow the T-seal to move while it has a pressure differential on it from sealing engagement to a recessed area without damage to the seal.

While the invention has been shown in only one of its forms, it should be apparent to those skilled in the art that it is not so limited, but is susceptible to various changes without departing from the scope of the invention.

I claim:

1. In a running tool for remotely setting a casing hanger seal in a pocket between a casing hanger and a subsea wellhead housing, having a mandrel which has an upper end adapted to connect to a string of conduit, a body carried by the mandrel and adapted to releasably connect to the casing hanger, an energizing member adapted to releasably carry the casing hanger seal and being movable relative to the body between an upper position wherein the casing hanger seal is spaced above the pocket and a lower position in which the casing hanger seal locates in the pocket, a bulk seal mounted above the casing hanger seal, a setting sleeve mounted to the mandrel and engageable with the bulk seal and downwardly movable relative to the energizing member to cause the bulk seal to seal against the wellhead housing when the casing hanger seal is in the pocket, to enable hydraulic pressure to be applied to the interior of the wellhead housing above the bulk seal to set the casing hanger seal, the improvement comprising:

indicating means for indicating when the casing hanger seal has properly landed in the pocket; and safety means cooperating with the indicating means for preventing the setting sleeve from moving downward relative to the energizing member unless the casing hanger seal has properly landed in the pocket.

2. The running tool according to claim 1 wherein the indicating means comprises:

a stop shoulder located on the body at a selected position.

3. The running tool according to claim 1 wherein the safety means comprises:

a safety ring located between the setting sleeve and the energizing member, having a locked position preventing downward movement of the setting sleeve relative to the energizing member, and a released position allowing downward movement of the setting sleeve relative to the energizing member, the safety ring being actuable by the indicating means.

4. The running tool according to claim 1 wherein the safety means comprises:

a safety ring located between the setting sleeve and the energizing member, having a radially contracted locked position preventing downward movement of the setting sleeve relative to the energizing member, and a radially expanded released position allowing downward movement of the setting sleeve relative to the energizing member, the safety ring being actuable by the indicating means.

5. The running tool according to claim 1 wherein:

the indicating means comprises a stop shoulder located on the body at a selected position; and the safety means comprises:

a downward facing shoulder on the setting sleeve;

an upward facing shoulder on the energizing member directly below the downward facing shoulder;

a split safety ring located between the upward and downward facing shoulders, having a locked position in which the safety ring engages both of the upward and downward facing shoulders, preventing downward movement of the setting sleeve relative to the energizing member; and wherein contact of the safety ring with the stop shoulder expands the safety ring outward to a released position, such that the safety ring ceases to engage one of the upward and downward facing shoulders, allowing downward movement of the setting sleeve relative to the energizing member.

6. A running tool for remotely setting a casing hanger seal in a pocket between a casing hanger and a subsea wellhead housing which has a bore, comprising in combination:

a mandrel which has an upper end adapted to connect to a string of conduit;

a body carried by the mandrel and adapted to releasably connect to the casing hanger;

a setting sleeve mounted to the mandrel for axial movement therewith, having a downward facing compression shoulder;

an energizing member carried by the setting sleeve and adapted to releasably carry the casing hanger seal, the energizing member having an upward facing compression shoulder spaced below the downward facing compression shoulder;

a bulk seal mounted above the casing hanger seal between the compression shoulders;

the mandrel, setting sleeve and energizing member being movable downward relative to the body to position the casing hanger seal in the pocket and the bulk seal in the bore of the wellhead housing;

a stop shoulder on the body; and a safety device carried by the setting sleeve which prevents downward movement of the compression shoulders toward each other until the safety device contacts the stop shoulder, which occurs when the casing hanger seal is properly located in the pocket, at which time movement of the compression shoulders toward each other deforms the bulk seal into sealing engagement with the wellhead housing, to enable hydraulic pressure to be applied to the interior of the wellhead housing above the bulk seal to set the casing hanger seal.

7. The running tool according to claim 6, wherein the safety device comprises:

a safety ring located between the setting sleeve and the energizing member, having a locked position preventing downward movement of the setting sleeve relative to the energizing member and a released position, allowing downward movement of the setting sleeve relative to the energizing member, the safety ring being actuable by the stop shoulder.

8. The running tool according to claim 6 wherein the safety device comprises:

a safety ring located between the setting sleeve and the energizing member, having a radially contracted locked position preventing downward movement of the setting sleeve relative to the energizing member and a radially expanded released position, allowing downward movement of the setting sleeve relative to the energizing member, the safety ring being actuable by the stop shoulder.

9. The running tool according to claim 6 wherein the safety device comprises:

a downward facing shoulder on the setting sleeve;

an upward facing shoulder on the energizing member directly below the downward facing shoulder;

a split safety ring located between the downward facing shoulder and the upward facing shoulder, having a locked position in which the safety ring engages both of the upward facing and downward facing shoulders, preventing downward movement of the setting sleeve relative to the energizing member; and wherein contact of the safety ring with the stop shoulder expands the safety ring outward to a released position, such that the safety ring ceases to engage one of the upward facing and downward facing shoulders, allowing downward movement of the setting sleeve relative to the energizing member.

10. In a running tool for remotely setting a casing hanger seal in a pocket between a casing hanger and a subsea wellhead housing which has a bore, having a mandrel which has an upper end adapted to connect to a string of conduit, a body carried by the mandrel and adapted to releasably connect to the casing hanger, a setting sleeve mounted to the mandrel for axial movement therewith, having a downward facing compression shoulder, an energizing member carried by the setting sleeve and adapted to releasably carry the casing hanger seal, the energizing member having an upward facing compression shoulder spaced below the downward facing compression shoulder, a bulk seal mounted between the compression shoulders, the mandrel, setting sleeve and energizing member being movable downward relative to the body to position the casing hanger seal in the pocket and the bulk seal in the bore of the wellhead housing, the improvement comprising:

a stop shoulder on the body; and a safety ring carried by the setting sleeve between the setting sleeve and the energizing member, which prevents downward movement of the downward facing compression shoulder relative to the upward facing compression shoulder until the safety ring contacts the stop shoulder, which occurs when the casing hanger seal is properly located in the pocket, at which time downward movement of the downward facing compression shoulder deforms the bulk seal into sealing engagement with the wellhead housing, to enable hydraulic pressure to be applied to the interior of the wellhead housing above the bulk seal to set the casing hanger seal.

11. The running tool according to claim 10 wherein the safety ring is a split ring which has a radially contracted locked position preventing downward movement of the setting sleeve relative to the energizing member, and a radially expanded released position allowing downward movement of the setting sleeve relative to the energizing member, and wherein the stop shoulder pushes the safety ring to the released position when contacted by the safety ring.

12. The running tool according to claim 10 wherein: the safety ring is a split ring:

the setting sleeve has a downward facing shoulder;

the energizing member has an upward facing shoulder directly below the downward facing shoulder;

the safety ring locates between the downward facing shoulder and the upward facing shoulder, having a locked position in which the safety ring engages both of the upward facing and downward facing shoulders, preventing downward movement of the setting sleeve relative to the energizing member; and wherein contact of the safety ring with the stop shoulder expands the safety ring outward to a released position wherein the safety ring ceases to engage one of the upward facing and downward facing shoulders, allowing downward movement of the setting sleeve relative to the energizing member.

13. A method for remotely setting a casing hanger seal in a pocket between a casing hanger and a subsea wellhead housing by using a running tool comprising a mandrel, a body carried by the mandrel, a setting sleeve mounted to the mandrel, an energizing member carried by the setting sleeve, and a bulk seal mounted above the casing hanger seal between the setting sleeve and the energizing member and settable in the wellhead housing by downward movement of the setting sleeve relative to the energizing member, the method comprising:

connecting the mandrel to a string of conduit;

securing the casing hanger seal to the energizing member;

engaging the body with the casing hanger; then lowering the mandrel relative to the body while preventing the setting sleeve from moving downward relative to the energizing member unless the casing hanger seal has properly landed in the pocket; then lowering the setting sleeve relative to the energizing member to set the bulk seal; then applying hydraulic pressure to the interior of the wellhead housing above the bulk seal to move the setting sleeve and energizing member downward relative to the body to set the casing hanger seal.

14. The method according to claim 13, further comprising:

after setting the casing hanger seal, releasing the energizing member from the casing hanger seal; then pulling the mandrel upward relative to the body while the body still is engaging the casing hanger to release the energizing member from the casing hanger seal and to release the bulk seal from sealing engagement with the wellhead housing; then applying hydraulic pressure to the interior of the wellhead housing above the casing hanger seal to test the casing hanger seal while the body is still engaging the casing hanger.

15. A well tool for a subsea well, comprising in combination:

tubular first and second members, one located slidingly within the other, the first member having a cylindrical sealing surface and a recessed area spaced axially from the sealing surface;

a T-shaped elastomeric seal located within a sealing seat on the second member, having a flange and a leg extending radially from the flange for sealing against the sealing surface of the first member when the members are in a sealing position, the leg being spaced radially from the recessed area of the first member when the members are moved axially relative to each other to a nonsealing position; and a pair of metal support rings in engagement with the seal, to prevent the seal from being pulled from its seal seat due to pressure differential as the first and second members move between the sealing and nonsealing positions.

16. The well tool according to claim 15 wherein one of the support rings is located on an upper side of the leg and abuts the flange, while the other of the support rings is located on a lower side of the leg and abuts the flange.

17. The well tool according to claim 15 wherein:

one of the support rings is located on an upper side of the leg and abuts the flange, while the other of the support rings is located on a lower side of the leg and abuts the flange; and wherein the leg extends radially from the flange farther than the support rings to prevent the support rings from contacting the sealing surface.

18. The well tool according to claim 15 wherein:

one of the support rings is located on an upper side of the leg and abuts the flange while the other of the support rings is located on a lower side of the leg and abuts the flange; and wherein the support ring on the upper side of the leg has an upper surface containing bleed grooves, and the support ring on the lower side of the leg has a lower surface containing bleed grooves, the bleed grooves preventing the support rings from sealing against the seal seat.

* * * * *